US005417426A

United States Patent [19]

Bayer

[11] Patent Number: 5,417,426

[45] Date of Patent: May 23, 1995

[54] PUTT MARK PUTTER

[76] Inventor: Sylvester L. Bayer, 2121 N. Harriman St., Appleton, Wis. 54911

[21] Appl. No.: 177,526

[22] Filed: Jan. 4, 1994

[51] Int. Cl.[6] ..... A63B 53/00

[52] U.S. Cl. ..... 273/162 D; 273/162 E

[58] Field of Search ..... 273/162 D, 162 E, 32 A

[56] References Cited

U.S. PATENT DOCUMENTS 4,248,430 2/1981 Kepler ..... 273/162 E X 5,102,139 4/1992 Greig ..... 273/162 D

*Primary Examiner*—George J. Marlo

*Attorney, Agent, or Firm*—Ryan, Kees & Hohenfeldt

[57] ABSTRACT

A putter for enabling marking a ball on the green by dropping a marking disk behind the ball without bending over simply by placing the putter head over the ball and releasing a marking disk from a magnet located under the putter in a position where by the ball trips the marker disk on entry into the opening on the putter head. The circular hollow retains the ball thus completing the marking process without the usual bending over and marking with the hand and fingers of the golfer. Three magnets are used in the functions of this putter invention. One magnet holds the disk marker in storage on the top back portion of the putter. Another magnet performs the trip marking as stated above. A third magnet allows the option of marking a ball by placing the marker disk on a frontal magnet on the bottom of the putter just behind the putter face allowing the golfer to place the putter behind the ball pinching the marker between the grass and the magnet. Again without bending over and from a standing posture the golfer may mark a ball and retrieve it simply by sliding the putter head away from the marker disk. This option of marking differs form the trip marking method in that the ball is picked up after placement of the disk. This is performed simply by placing the putter head over the ball and into the circular hollow and retrieved.

5 Claims, 2 Drawing Sheets

FIG.8
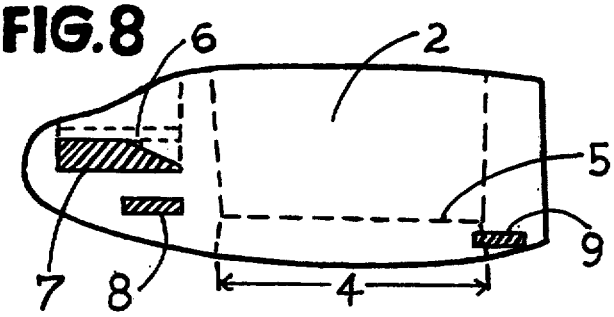
FIG.15
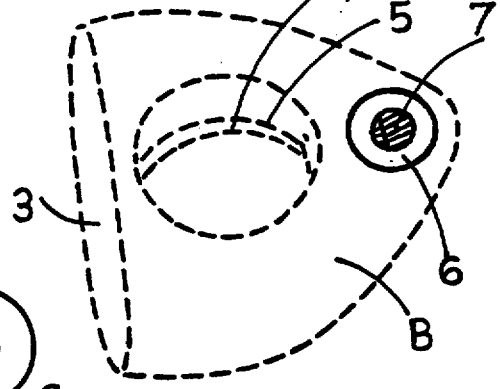
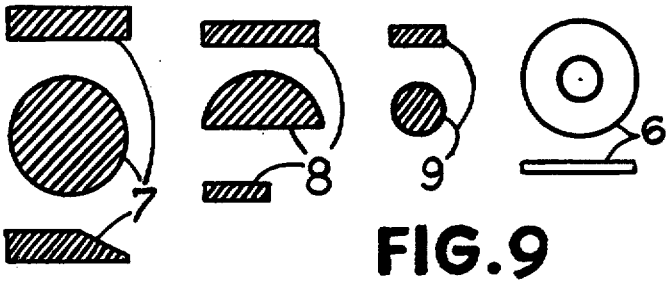
FIG.9
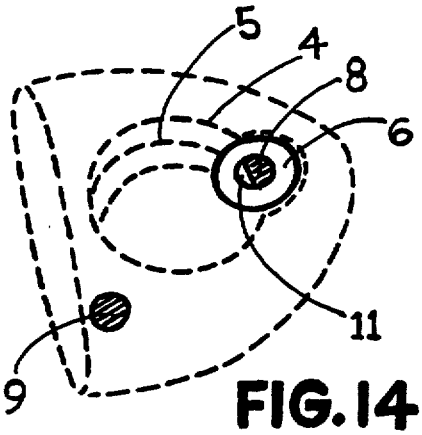
FIG.14
FIG.10
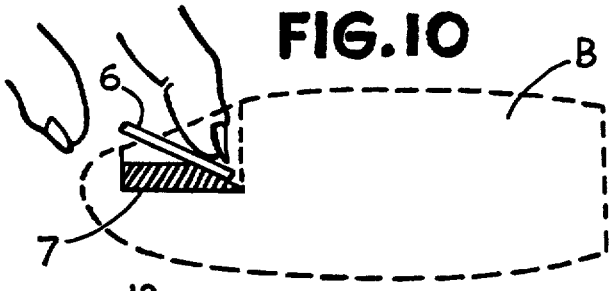
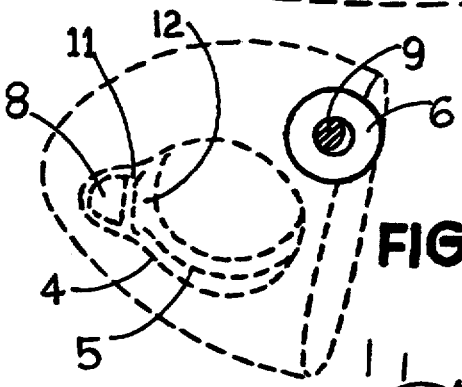
FIG.11
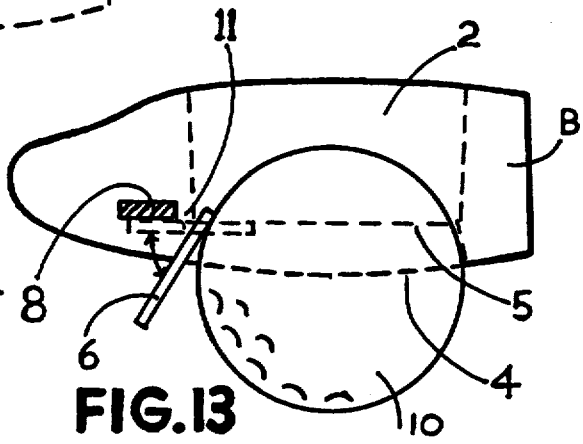
FIG.13
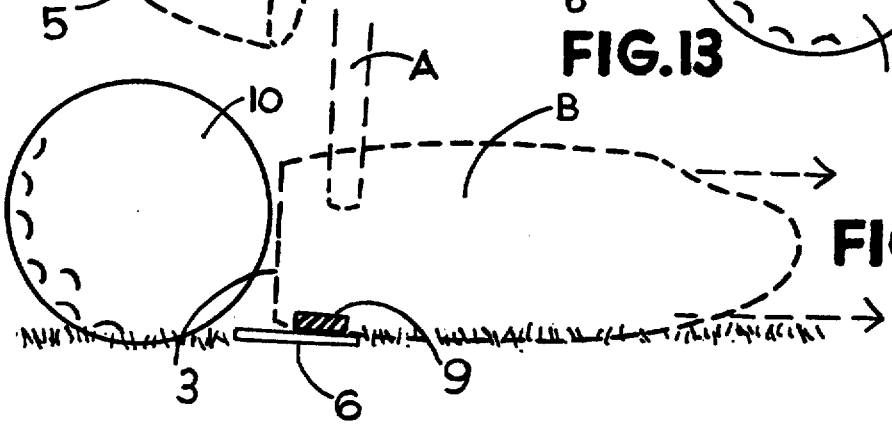
FIG.12

PUTT MARK PUTTER

BACKGROUND OF THE INVENTION

This is a continuation-in-part of a Disclosure Document number 299669 which contains several versions of the spirit of this invention featuring the ability of magnets to function within the confines of a putter head to aid in marking a golf ball without the need of bending or stretching.

1. Field of the invention

The present invention relates to a putter used for golf; and more particularly relates to an improved putter enabling marking a ball on the putting surface from a standing posture of a golfer without bending the body or stretching an arm.

2. Description of prior art;

In order to mark a ball on the putting surface, such forced posture as bending the body while stretching an arm is compelled to be assumed in order to place a marker disk behind the ball with the fingers of the golfer and them retrieve the ball by hand from the above forced posture. On the other hand, there has not existed hitherto a putter enabling marking a ball on the surface of a putting green in a standing posture by employing a putter equipped with the use of magnets and the force provided thereof to manipulate placement of marker disks.

SUMMARY OF THE INVENTION

The present invention seeks to overcome the aforementioned conventional defect by providing an improved putter enabling one to mark a ball on the surface of a green surely and comfortably without assuming a forced posture.

It is an object of the present invention to provide an improved putter enabling one to mark a ball on the green surely and easily in a standing posture using a marker disk which is easily removed from a carrying magnet located on the head of said putter used for golf play. An additional object of the present invention is to provide a putter enabling putting the ball at the center of a flat faced portion of the head in employing a conventional putter having a laterally stretching configuration.

The afore mentioned objects can be attained by a putter comprising one end portion of a shaft A, FIG. 1 firmly secured to a head B FIG. 1 made of aluminum or other materials similar thereto, said head B being substantially in the shape of an oval forming arcs extending from both ends of a flat faced portion 3, as to constitute a circular hollow portion 2 said circular hollow 2 having a diameter of 1.72 inches 4, FIG. 6 which is tapered upward from the bottom of said putter B to a 1.67 inch diameter FIG. 6, with a distance of one quarter inch upwards to the diameter 5 shown in FIGS. 6, 8 and 15. The purpose of the taper is to allow trapping of a golf ball of various sizes smaller than 1.72 diameter which in turn places the ball in the correct location for releasing the marker disk as it passes upward into the inner peripheral surface 4 of said hollow portion, 2.

BRIEF DESCRIPTION OF THE DRAWINGS

Other and further objects of the present invention will become apparent from the following detailed description with reference to the drawings which by way of example, illustrate preferred embodiments of the invention, in which;

FIG. 8–15 illustrate the magnets and their locations within the confines of the putter head and how they function.

FIG. 9 is a group view showing the top and side views of the 3 magnets used in the invention. The marker disk 6 is also shown in this grouping to the right of the magnets.

DESCRIPTIONS OF THE PREFERRED EMBODIMENTS

Figure 2:
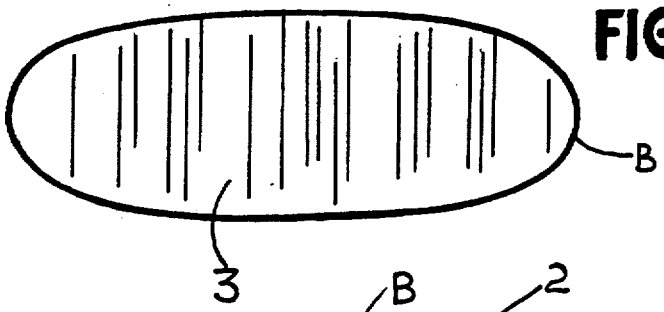
FIG. 2 is a frontal view.

The present invention will be described in detail with reference to the drawings. It shall be understood that the illustrated embodiment is susceptible to modification and change without departing from the spirit of the invention. The same numeral is given to the same part in the drawings.

Figure 1:
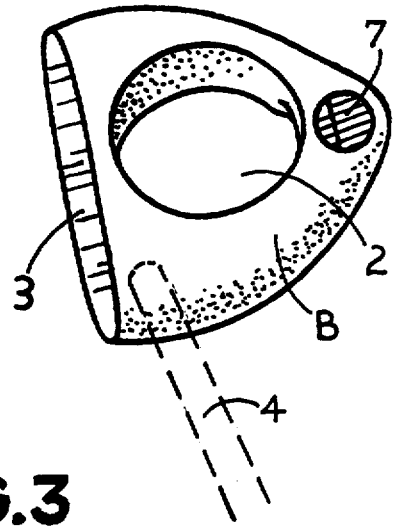
FIG. 1 is a perspective view from the top of a putter according to the present invention.
Figure 3:
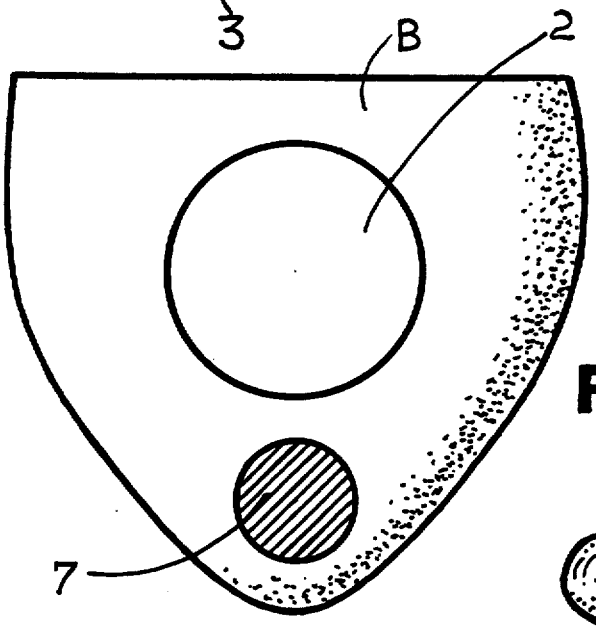
FIG. 3 is a top view.
Figure 4:
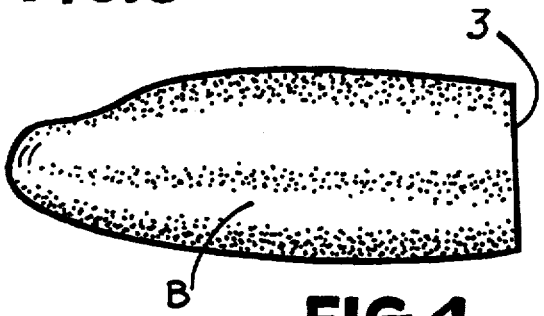
FIG. 4 is a side view.
Figure 5:
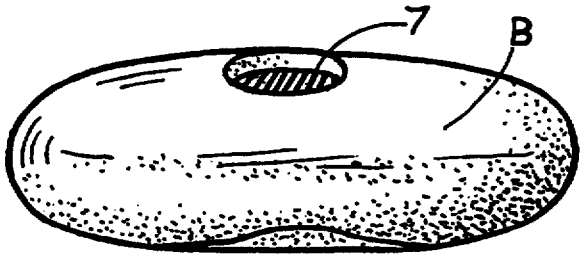
FIG. 5 is a back view.
Figure 6:
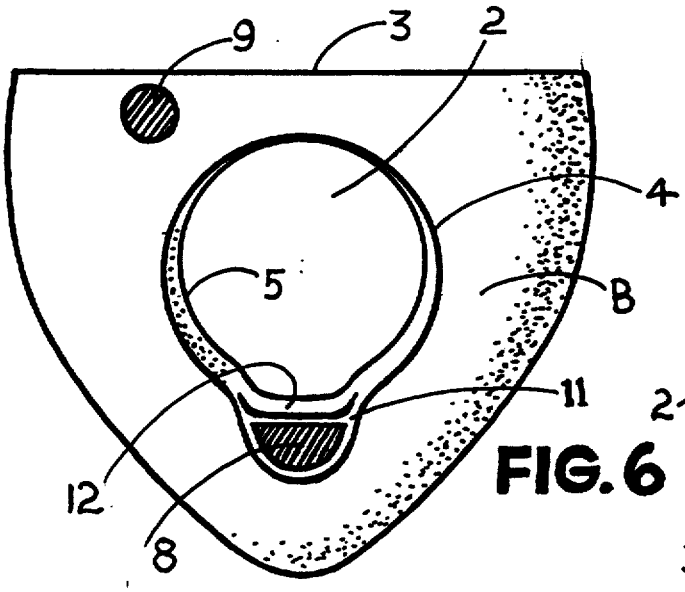
FIG. 6 is a bottom view.
Figure 7:
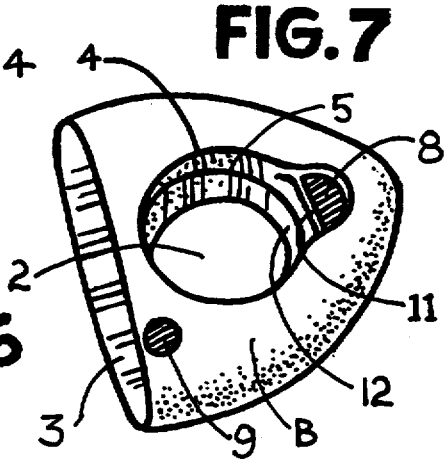
FIG. 7 is a perspective view from the bottom.

FIG. 1 is a perspective view of a putter according to the invention. In FIG. 1, A is a putter shaft and B is a head of said putter. The dotted lines indicate the shaft location and is not a component of the invention. The head B made of aluminum or other suitable metal, has a configuration of a flat faced portion 3 for putting a ball and a curvature extending from both ends of the portion 3 to constitute the head on the shape of a ring with a hollow portion 2 in the center. The length of said faced portion 3 in its lateral direction should be longer than that of a diameter of the ball and the length of the portion 3 in the vertical direction should be larger than half of the ball diameter so as to strike the ball at the center of portion 3 in the vertical direction when putting. FIG. 3 depicts the holding magnet 7 in its carrying position. FIG. 5 shows said magnet from the back view in position in the well or cavity in the putter head B. The marker disk 6 is shown in the carrying position on magnet 7 in FIG. 15 held snugly within the walls of the well or cavity on head B deep enough so that the top surface of marker disk 7 is slightly below the surface of the putter head B as shown is FIG. 8. FIG. 10 shows the manner in which the holding magnet 7 releases the marker disk 6 when the golfer apples pressure with a finger against the marker desk which in turn flips upward on its opposite end caused by the bevel in the magnet 7 forward portion thus allowing easy removal with thumb and finger. After removing the disk from its holding magnet 7 the golfer has two choices from which to mark the ball to the green: magnet 8 or 9. FIG. 12 shows the marking disk being used on magnet 9 and FIG. 13 depicts the disk being used on magnet 8. The dotted lines 6 in FIG. 13 indicates the marker disk in place before being tripped out of the head to the green by the ball 10 as it is forced against the trip bar 11 as the ball enters the opening 2 in head B. The weight of the putter head resting over the ball is enough force to free the marker disk from the holding power of the magnet which in turn causes it to fall freely to the green behind the ball at which point the ball remains secure in the head B opening 2 within the confines of the diameter of the wall opening which is less than the diameter of the ball FIG. 13. FIG. 12 depict the marker dish being placed in position simply by sliding the putter head away from the marker disk 6 and off the magnet 9. FIG. 11 shows the marker disk in position ready to be placed to the green as in FIG. 12 from a standing posture without bending or stretching. FIG. 6 illustrates the tapered opening 12 in head B next to the trip bar 11 and the trip magnet 8 which allows more room for the marker disk 6 to enter and be released away from magnet 8 as it is forced by the ball against trip bar 11 of FIG. 13 and FIG. 6. A second diameter 5 within the opening 2 in head B allows for a smaller ball other than the current largest 1.72 diameter ball to be contained. The opening in head B2 is of a diameter measuring 1.67 thus any ball smaller than 1.72 at diameter 4 will also be contained within its angle between diameter 4 and 5. The length of the vertical distance between 4 and 5 being one quarter of one inch.

FIG. 8 illustrates a side view showing the relative locations of the three magnets used in the invention. Doted line 5 depicts the smaller diameter opening in head B. Opening 2 dotted line 4 indicates the larger diameter opening at the base of the head B between the vertical dotted lines left and right.

What is claimed is:

1. A putter for golf having a head with a top surface, a bottom surface, and sides generally shaped in the form of an arc extending rearwardly from both ends of a straight faced ball striking portion, a marker disk dispensing depression in the putter head bottom surface, a magnet adjacent to said depression, a magnetically attractable marker disk retained in said depression by said magnet, an opening in said bottom surface slightly smaller than the diameter of a golf ball which allows a ball to enter and trip said marking disk from said magnet, causing it to fall while retaining said ball therein.

2. A putter as described in claim 1 further including another magnet located on the bottom of the putter head.

3. A putter according to claim 1 wherein a third magnet is provided on the back top portion of the club head.

4. A putter head comprising;

1) a unitary structure having a top surface and a bottom surface and a thickness and the putter head in plan view has a D-shape and the central area of the D-shape defines a bore which is slightly smaller than the diameter of a golf ball and said bore passes through the thickness of the putter head from the top surface to the bottom surface, 2) a means for securing a putter handle to said putter head, 3) a shallow cylindrical marker storage depression formed in said top surface and the storage depression has a magnet incorporated into its bottom structure, and said bottom structure of said depression is parallel to the top surface for a portion of its area and said bottom structure has a downwardly angled surface for a portion of its area, 4) a shallow cylindrical marker dispensing depression formed in the bottom surface of said putter head adjacent to said bore such that the center of said marker dispensing depression is positioned a distance less than the length of its radius from the bottom perimeter of the bore and the marker dispensing depression has a substantially planer bottom surface which is parallel to the bottom surface of said putter head and the bottom surface of said marker dispensing depression has a magnet incorporated into its structure, and 5) a disc shaped metal ball marker that, is receivable in said marker storage depression and in said marker dispensing depression, and said marker is attractable by a magnet.

5. The putter head of claim 4 wherein a magnet is incorporated into the structure of the lower surface of the putter head and adjacent to the straight segment of the D-shape.

* * * * *